US007052359B2

(12) United States Patent
Chen et al.

(10) Patent No.: US 7,052,359 B2
(45) Date of Patent: May 30, 2006

(54) BACKLESS, STRAPLESS BRA

(76) Inventors: David E. Chen, 20912 Granite Wells Rd., Walnut, CA (US) 91789; Jasper Chang, 2856 Bentley Way, Diamond Bar, CA (US) 91765; Alice Chang, 2856 Bentley Way, Diamond Bar, CA (US) 91765

( * ) Notice: Subject to any disclaimer, the term of this patent is extended or adjusted under 35 U.S.C. 154(b) by 0 days.

(21) Appl. No.: 11/179,383

(22) Filed: Jul. 11, 2005

(65) Prior Publication Data

US 2005/0250418 A1 Nov. 10, 2005

Related U.S. Application Data

(63) Continuation of application No. 10/801,479, filed on Mar. 15, 2004, now Pat. No. 6,916,224, which is a continuation of application No. 10/211,110, filed on Aug. 2, 2002, now Pat. No. 6,780,081.

(51) Int. Cl.
*A41C 3/00* (2006.01)

(52) U.S. Cl. ..... 450/54; 450/81; 450/58

(58) Field of Classification Search ..... 450/81, 450/37–39, 54–58; 2/267, 268, 96
See application file for complete search history.

(56) References Cited

U.S. PATENT DOCUMENTS

| | | | | |
|---|---|---|---|---|
| 817,020 | A * | 4/1906 | Thompson | 450/54 |
| 2,079,426 | A * | 5/1937 | Schottenfels | 450/81 |
| 2,579,365 | A * | 12/1951 | Conde | 450/39 |
| 2,728,079 | A | 12/1955 | Williams | |
| 2,793,369 | A * | 5/1957 | Panighini | 450/53 |
| 2,844,151 | A | 7/1958 | Lemons | |
| 2,869,553 | A | 1/1959 | D'Or | |
| 2,882,905 | A | 4/1959 | Barg | |
| 3,196,878 | A | 7/1965 | Hedu | |
| 3,280,818 | A | 10/1966 | Pankey et al. | |
| 3,297,036 | A | 1/1967 | Williams | |
| 3,556,107 | A | 1/1971 | Brumfield | |
| 3,749,102 | A | 7/1973 | Wynants | |
| 3,934,593 | A | 1/1976 | Mellinger | |

(Continued)

FOREIGN PATENT DOCUMENTS

| | | |
|---|---|---|
| DE | 0216441 | 7/1961 |

(Continued)

OTHER PUBLICATIONS

Abstract and Figures Only for French Patent No. 2505620 (Nov. 19, 1982).

(Continued)

*Primary Examiner*—Gloria M. Hale
(74) *Attorney, Agent, or Firm*—Christie, Parker & Hale, LLP

(57) ABSTRACT

An improved backless, strapless bra comprising a pair of bra cups having an interior surface facing towards a user's skin that comprises a pressure sensitive adhesive layer disposed thereon for adjoining the bra cups to the user's skin. The bra cups are permanently or removably adjoined by a connector that is positioned between inner side portions of the bra cups. The connector can have a variety of configurations that enable the user to attach the bra cups. The connector allows the user to create a desired amount of breast cleavage and breast push-up enhancement. The bra can also be used with a pull-up device that attaches to the top portion of the bra cups and allows the user to lift the bra cups and the user's breasts to provide additional breast push-up enhancement.

9 Claims, 8 Drawing Sheets

U.S. PATENT DOCUMENTS

| | | | | |
|---|---|---|---|---|
| 4,553,550 | A | 11/1985 | Hattori | |
| 4,992,074 | A | 2/1991 | Diaz | |
| 5,352,307 | A * | 10/1994 | Wild | 156/66 |
| 5,538,502 | A | 7/1996 | Johnstone | |
| 5,755,611 | A * | 5/1998 | Noble et al. | 450/39 |
| 5,792,292 | A | 8/1998 | Wild | |
| 5,922,023 | A | 7/1999 | Mulligan et al. | |
| D419,279 | S | 1/2000 | Marco et al. | |
| 6,200,195 | B1 | 3/2001 | Furuno et al. | |
| 6,231,424 | B1 | 5/2001 | Valentin | |
| 6,253,424 | B1 * | 7/2001 | Rainville-Lonn | 24/306 |
| 6,257,951 | B1 * | 7/2001 | DeMarco | 450/55 |
| 6,257,952 | B1 | 7/2001 | Valentin | |
| 6,283,820 | B1 | 9/2001 | Huang | |
| 6,758,720 | B1 * | 7/2004 | Chen | 450/57 |
| 6,780,081 | B1 * | 8/2004 | Chen et al. | 450/81 |
| 6,852,001 | B1 * | 2/2005 | Chen et al. | 450/57 |
| 6,916,224 | B1 * | 7/2005 | Chen et al. | 450/57 |
| 2001/0021620 | A1 | 9/2001 | DeMarco | |
| 2001/0027079 | A1 | 10/2001 | Valentin | |

FOREIGN PATENT DOCUMENTS

| | | | |
|---|---|---|---|
| FR | 989453 | A | 9/1951 |
| FR | 1092914 | | 4/1955 |
| GB | 0785851 | | 11/1957 |
| GB | 2208785 | A | 4/1989 |
| KR | 10-0419298 | | 2/2004 |

OTHER PUBLICATIONS

Figures Only for Italian Patent No. IT 0521811 (May 1955).

Dr. Leonard's—America's Leading Discount Healthcare Catalog, p. 15, Natural Looking Breast Enhancer Pads, Silicone Covered with Film, 1998.

* cited by examiner

BACKLESS, STRAPLESS BRA

CROSS-REFERENCE TO RELATED APPLICATION(S)

This application is a continuation of U.S. patent application Ser. No. 10/801,479, filed Mar. 15, 2004 now U.S. Pat. 6,916,224, which is a continuation of U.S. patent application Ser. No. 10/211,110, filed Aug. 2, 2002 now U.S. Pat. No. 6,780,081.

FIELD OF THE INVENTION

The present invention relates to an improved backless, strapless bra, and more particularly, to a backless, strapless bra having an interior surface having a pressure sensitive adhesive layer for adjoining the bra cups to the user's skin.

BACKGROUND OF THE INVENTION

Various devices and methods are available to women who wish to enhance their breasts. Generally, women can either undergo a surgical procedure to be fitted with a breast implant, or can use some form of externally worn article. To accommodate women wishing to avoid the dangers involved with surgical breast implants, several efforts have been made to provide externally worn articles that have the look and feel of natural breasts, yet are non-permanent and health-risk free. Such externally worn devices have included a wide range of foam pads, push-up bras, and more recently gelled breast inserts to be worn between the user's breasts and a bra.

In addition to the demand for devices and methods for enhancing breast size and shape, there is also a demand for being able to use those devices and methods while wearing a full-range of clothing. For example, women wearing a backless dress or a halter top will not want to wear a traditional bra. As a result, bras have been developed that are both backless and strapless. Such backless, strapless bras have used non-permanent adhesives, such as a disposable double-sided tape, to secure the bra to the user. Furthermore, known backless, strapless bras have relied on extension tabs that extend from the outer surface of the bra cups to secure the bra cups to the user's skin, and have provided very limited means for enhancing breast cleavage and breast push-up.

As a result, there exists a need for a backless, strapless bra having a system for pushing-up the breasts and enhancing breast cleavage. Further, there exists a need for such a bra having a permanent and re-usable adhesive that allows the user to position the bra in a desired position without the use of extension tabs and without concern of the bra shifting from that position.

SUMMARY OF THE INVENTION

The present invention provides an improved backless, strapless bra comprising a pair of bra cups having an interior surface facing towards a user's skin that comprises a pressure sensitive adhesive layer for adjoining the bra cups to the user's skin. The pressure sensitive adhesive layer is adjoined to a PSA supporting layer, which can be formed from a variety of different types of films or fabrics. The bra cups are permanently or removably adjoined by a connector that is positioned between inner side portions of the bra cups. The connector can have a variety of configurations that enable the user to attach the bra cups. The connector allows the user to create a desired amount of breast cleavage and breast push-up enhancement.

The present bra eliminates the aforementioned problems and shortcomings of existing backless, strapless bras. There is no needs for extension tabs or the like to attach the bra to the user. Rather, the pressure sensitive adhesive layer itself is the only required means for adjoining the bra to the user. Furthermore, the preferred pressure sensitive adhesive is permanently grown to a thermoplastic film that comprises a portion of the interior surface of the bra cups.

An additional feature available for the present bra is a pull-up device that attaches to the top surface of the bra cups and allows the user to lift the bra cups and the user's breasts to provide additional breast push-up enhancement.

DETAILED DESCRIPTION

Figure 1:
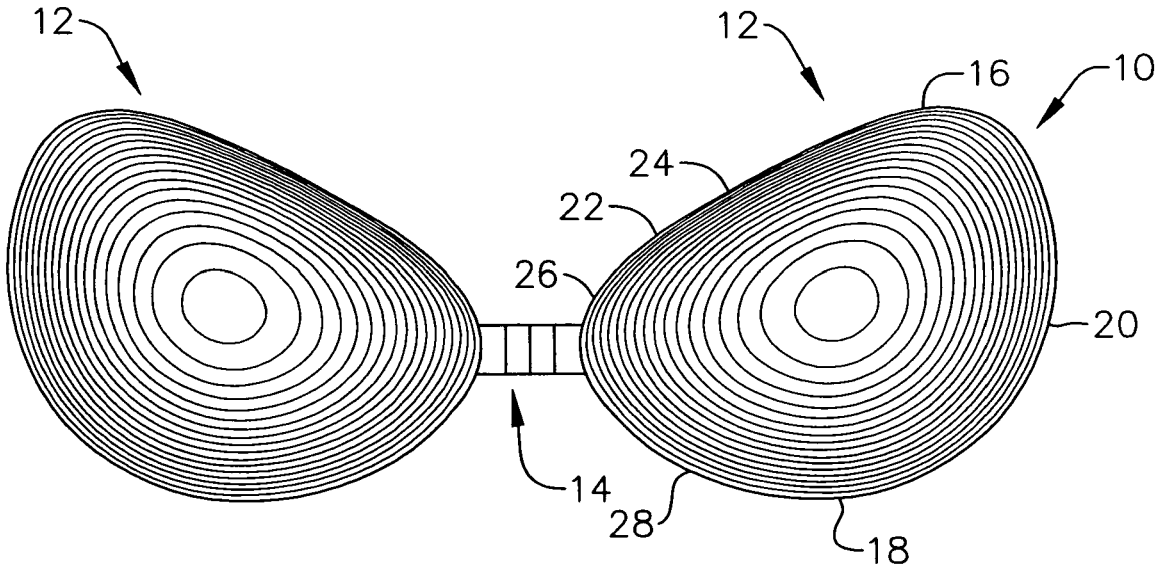
FIG. 1 is a front view of a bra having a pair of bra cups adjoined by a connector.

An improved backless, strapless bra constructed according to principles of this invention, generally comprises a pair of bra cups adjoined by a connector. FIG. 1 illustrates a front view of a backless, strapless bra 10 of this invention. The bra 10 includes a pair of bra cups 12 adjoined by a connector 14 that is positioned between opposing surfaces of the two bra cups. The bra cups 12 each have a pressure sensitive adhesive layer that enables the bra cups to be removably attached to each of a user's left and right breasts. The bra cups 12 are separate articles that are independently placed on a left and right breast of a user. Each of the bra cups 12 has the same structure, except one is designed to support and enhance the left breast and the other is designed to support and enhance the right breast. Furthermore, the bra cups can be either permanently or removably adjoined by the connector.

Generally, the user of the bra 10 positions the pressure sensitive adhesive layer of each of the bra cups 12 on the left and right breasts, and then adjoins the bra cups to each other by engaging the connector 14. The user can create varying degrees of breast cleavage and breast push-up enhancement depending on where the bra cups are positioned on the user's breasts and how much the connector 14 pulls the two bra cups towards each other. Furthermore, the placement of the connector relative to the top and bottom of the bra cups will impact the degree of cleavage and push-up enhancement. Accordingly, the bra 10 enables the user to position the bra cups at a desired position and control the amount of cleavage and push-up enhancement by adjoining the bra cups with the connector. It is also possible, however, for the bra cups to be permanently adjoined together by a fixed connector.

Figure 2:
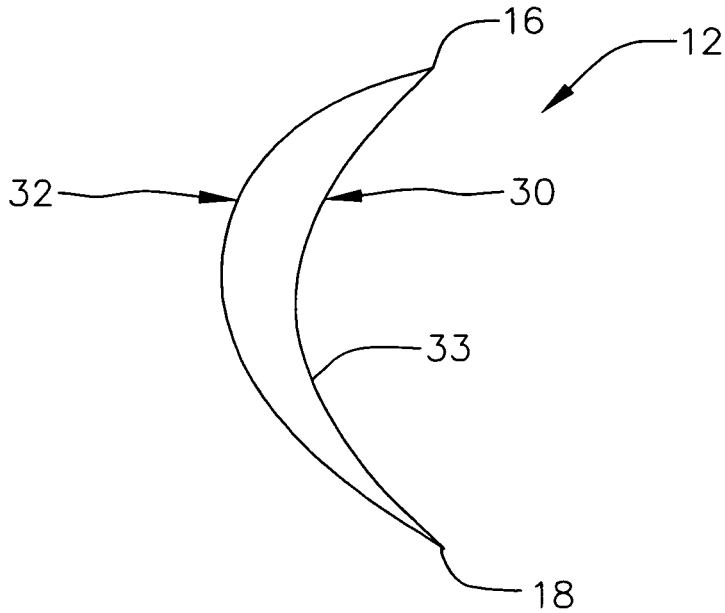
FIG. 2 is a side view of one of the bra cups shown in FIG. 1.

A front view of the bra cups 12 is shown in FIG. 1. Each bra cup 12 has a top 16, a bottom 18 opposite the top, an outer side 20, and an inner side 22 opposite the outer side. Each bra cup also defines an inner top 24, an inner middle 26, and an inner bottom 28. Referring to FIG. 2, each bra cup 12 defines two surfaces relative to the user, an interior surface 30 facing towards the user's breasts, and an exterior surface 32 facing opposite the interior surface and away from the user's breasts. The interior surface 30 includes a pressure sensitive adhesive layer 33 that adjoins the bra cups to the user's skin.

The pressure sensitive adhesive (PSA) layer 33 allows the user to place each of the bra cups at a position on the user's breasts that will create a desired support and appearance of the breasts. The amount and type of PSA comprising the pressure sensitive adhesive layer 33 can vary, as can the portions of the interior surface that have the pressure sensitive adhesive layer. Various factors can contribute to the amount, type, and placement of the pressure sensitive adhesive layer such as the size, shape, and weight of the bra cup and the user's breasts.

The pressure sensitive adhesive layer 33 is preferably a re-usable PSA that is permanently grown to the interior surface 30 of each bra cup. The pressure sensitive adhesive layer can also be applied to the interior surface of the bra cups by other methods such as spray coating, hot melting, extrusion application, die application, or other methods known for applying a PSA to a substrate. Unlike known adhesives, the pressure sensitive adhesive layer 33 will not readily shift once it is positioned on the user and can be re-used repeatedly without losing its adhesive properties. The pressure sensitive adhesive layer 33 has an adhesion force to the bra cups 12 that is greater than a cohesion force to the user's skin. The pressure sensitive adhesive layer is further able to withstand tremendous movement and pressure from the user without slipping and can even be subjected to water or sweat without degeneration of the adhesive properties. In fact, if the pressure sensitive adhesive layer becomes dirty (i.e. collects unwanted particles such as dust, lint, or debris), it can be cleaned with soap and water to remove the unwanted particles and fully restore the adhesive properties.

The bra cups 12 are each adapted to accommodate the connector 14. The connector 14 can have many different forms, but generally will have two or more separate portions, where a first portion attaches to one bra cup and a second portion attaches to the other bra cup. The first and second portions of the connector are designed to engage each other in order to adjoin the two bra cups. Furthermore, the separate portions of the connector 14 can be either permanently or removably attached to the bra cups. It is also possible for the connector 14 to be a single unit that removably attaches to both bra cups. The manner in which the connector 14 attaches to the bra cups will vary depending on the particular structures of the bra cups and the connector.

Figure 3A:
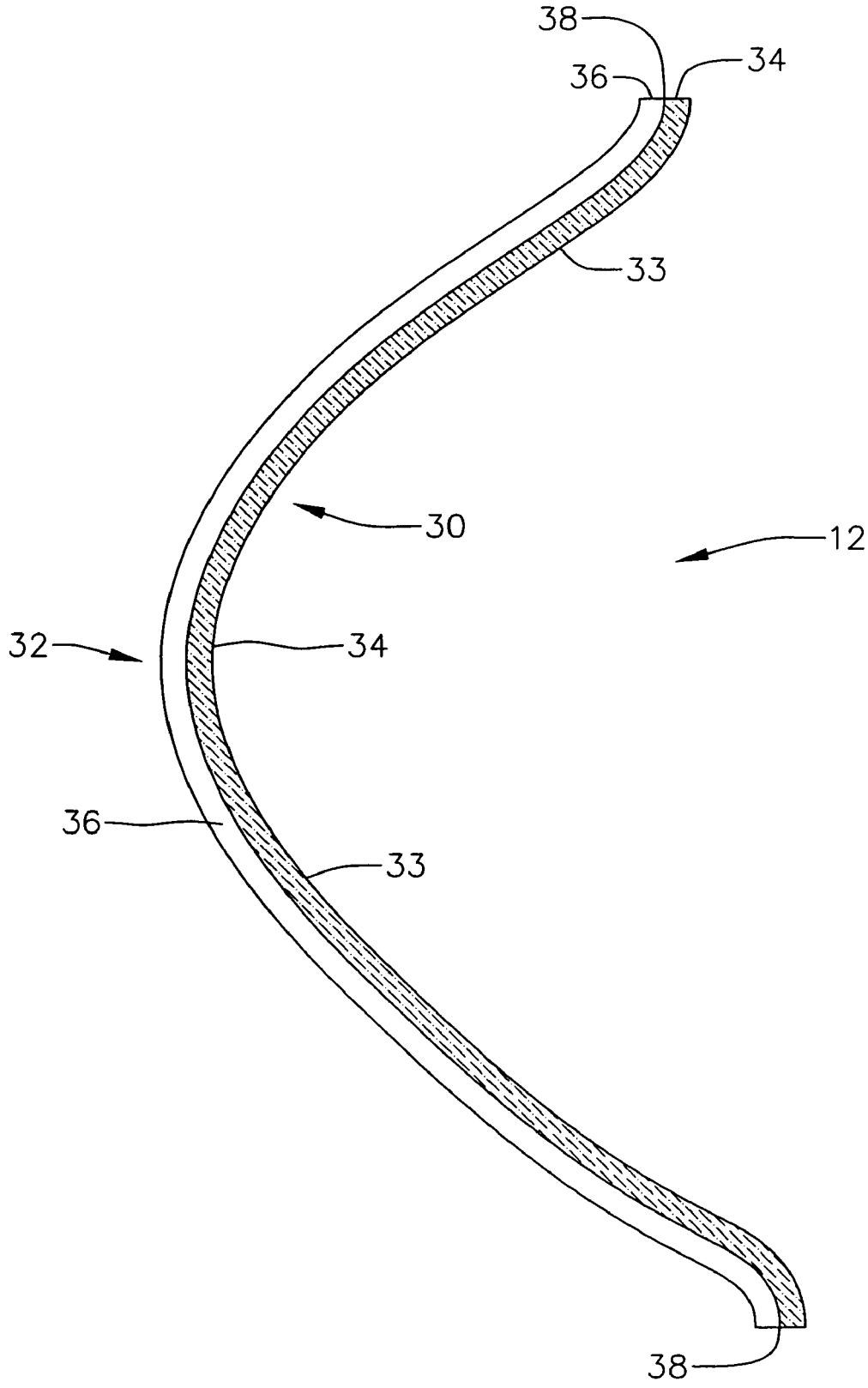
FIG. 3*a* is a side cross-sectional view of a bra cup having a fabric layer adjoined to a thermoplastic film material.

The bra cups 12 generally include one or more layers of materials adjoined together. For example, the interior surface 30 can be a layer comprising at least a portion of a plastic film material. Adjoined to the plastic film material can be a variety of different types of fabrics or other materials, such as foams and the like. Referring to FIG. 3*a*, a side cross-sectional view of the bra cup 12 is shown, wherein the bra cup has a sheet of thermoplastic film material 34 adjoined to a fabric layer 36. The thermoplastic film material and fabric layer can be permanently and inseparably adjoined by heat lamination or other similar processes. The thermoplastic film material can be any type of plastic or polymer that is suitable for heat lamination, such as polyurethane or the like. The point 38 represents the perimeter or the bra cup.

In the embodiment shown, the pressure sensitive adhesive layer can be permanently grown to the thermoplastic film material, or applied by the other methods discussed above. It is understood that the amount of pressure sensitive adhesive covering the interior surface of the bra cups and the amount of the thermoplastic film material forming the interior surface can vary depending on the desired design and function of the bra cups.

Figure 3B:
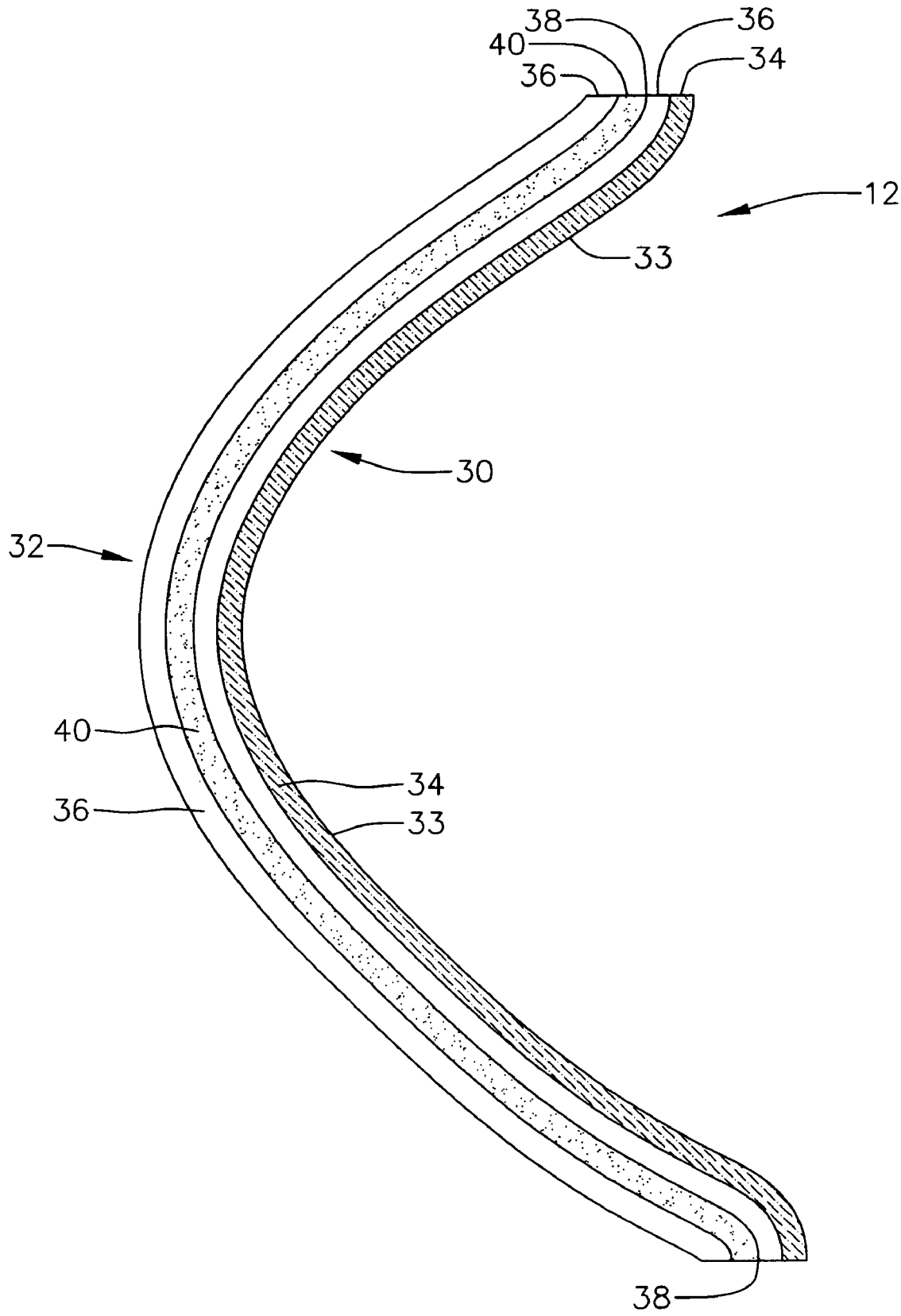
FIG. 3*b* is a side cross-sectional view of a bra cup having a foam material disposed between two layers of the fabric layer and adjoined to a thermoplastic film material.

FIG. 3*b* shows the bra cup 10 having an additional foam material 40 disposed between two layers of the fabric layer 36, such that the fabric layer defines the exterior surface 32 of the bra cup. It should be understood that the bra cup can include a variety of combinations of fabrics and materials that can form different layers of the bra cup. For example, the fabric layer can be made from any suitable material, such as a two-way or four-way stretchable material that allows the bra cup to conform to the user's breast shape. In the different configurations of bra cups, the thermoplastic film material 34 will be the layer nearest the user that defines the interior surface 30.

The bras shown in FIGS. 3*a* and 3*b* include the entire interior surface having the thermoplastic film material and the pressure sensitive adhesive layer, but various partial configurations and designs can be achieved. It is understood that the interior surface can be formed from a number of other materials besides a thermoplastic film material. The interior surface of the bra cups serves as a pressure sensitive adhesive support layer. The interior surface can be formed from any type of film material or fabric material suitable for adjoining to a PSA. One preferred fabric material is an unwoven fabric, which can be substantially impervious to the PSA. Additionally, various types of woven fabrics can be made suitable for the function of supporting the PSA layer. Thus, a variety of materials and methods can used to form the interior surface of the bra cups and for applying the PSA layer to the interior surface.

The bra 10 differs considerably from known backless, strapless bras because it does not require an additional portion for attaching to the user. The bra 10 does not require an extension tab having a double-sided tape that extends from the bra cup and attaches to the user's skin. Rather, the user of the bra 10 can simply attach the bra cups directly to the user's skin without having to use any other type of attachment system.

With respect to the means for connecting the bra cups 12, the connector 14 can be adjoined to the bra cup at the interior surface 30 or the exterior surface 32, or both surfaces. Because the particular material used to construct the bra cups will vary, the material to which the connector is adjoined should be able to withstand a number of different pulling forces without separating from the bra cups.

Figure 4A:
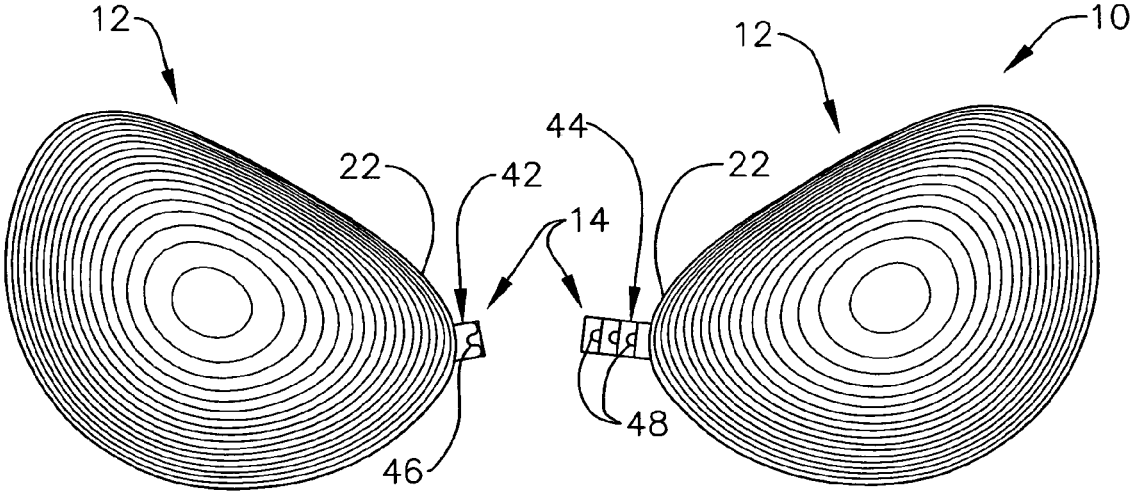
FIG. 4*a* is a front view of the bra of FIG. 1 having an adjustable connector that has not been engaged to adjoin the bra cups.
Figure 4B:
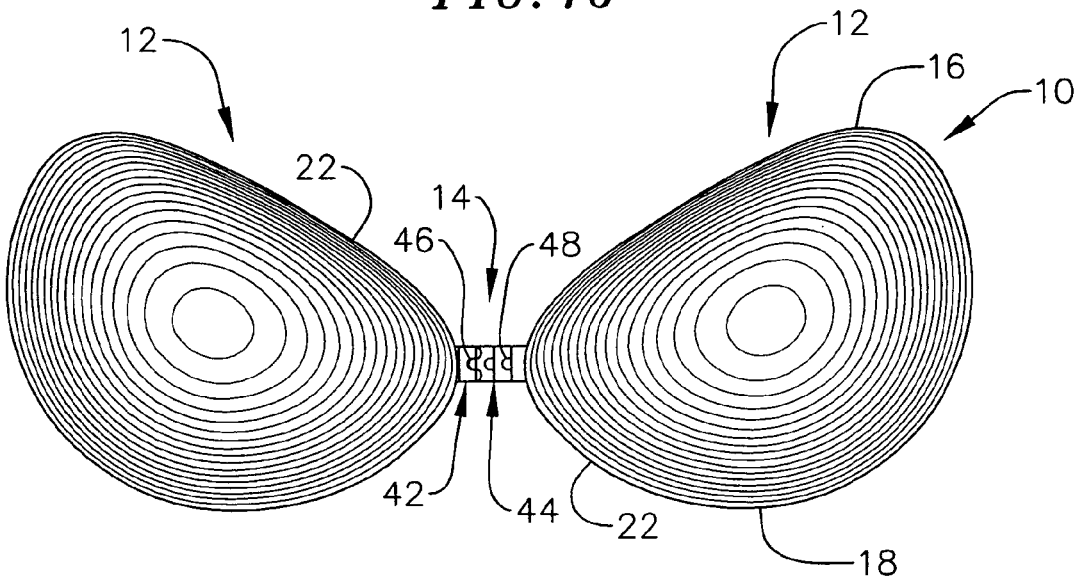
FIG. 4*b* is a front view of the bra of FIG. 4*a* wherein the connector has been engaged to adjoin the bra cups.

Referring to FIGS. 4*a* and 4*b*, the connector 14 is shown as an adjustable clasp assembly. In FIG. 4*a* the connector 14 has a first portion 42 attached to the inner side 22 of one of the bra cups 12, and a second portion 44 attached to the inner side 22 of the other bra cup 12. The first portion and the second portion are designed to engage each other in order to adjoin the two bra cups. It does not matter to which of the bra cups the first portion 42 and the second portion 44 are attached, so long as the first and second portions are oriented towards each other in a manner that allows them to cooperatively engage. The first portion 42 is shown having a clasp 46 that is adapted to fit within a plurality of loops 48 that are disposed on the second portion 44. The first portion and second portion are shown prior to being engaged.

FIG. 4*b* shows the first portion 42 engaged with the second portion 44, such that the connector 14 has adjoined the two bra cups 12. The clasp 46 is shown engaging the first of the three loops 48 of the second portion. Because the connector 14 is adjustable, the user could engage the clasp 46 with one of the other loops, which would result in the two bra cups being pulled closer towards each other, thereby creating more cleavage between the user's breasts.

In FIGS. 4*a* and 4*b*, the connector 14 is shown permanently fixed to the bra cups. More specifically, the first portion 42 and second portion 42 are permanently attached to the inner side 22 portions of the bra cups 12. However, it is possible for the first portion and second portion to be removably attached to the bra cups. For example, the first portion and second portion could attach to the bra cups by way of a button type assembly that snaps through a small hole in each of the bra cups. This would allow both portions of the connector to be removed from the bra cups, which would allow the user to wear the bra cups without adjoining the bra cups.

Figure 5:
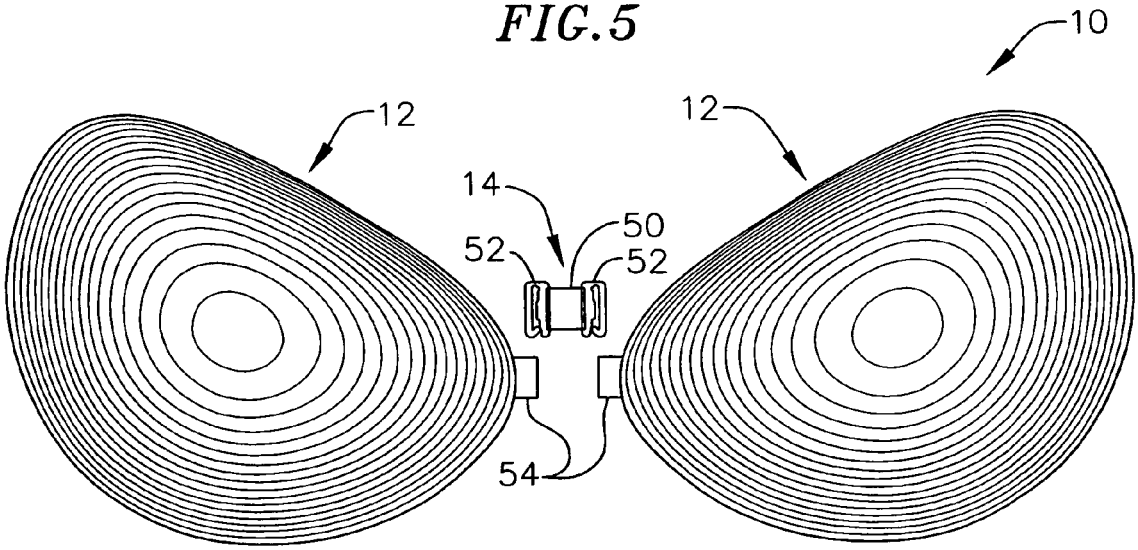
FIG. 5 is a front view of the bra of FIG. 1 having a single unit connector.

Another embodiment of the bra 10 is shown in FIG. 5. The connector 14 is shown as a single unit, as opposed to having two separate portions that adjoin. In the single unit shown, the connector 14 has a body 50 with a pair of hooks 52 attached at each end of the body. The body can be made of any suitable material such as plastic, metal, or various fabrics, such as an elastic fabric. The hooks 52 are adapted to slide into and engage a pair of loops 54 that are attached to the inner sides 22 of each bra cups. The loops 54 are shown permanently attached to the inner sides of each bra cup, and have a size that provides for a snug fit between the hooks and the loops. The loops can be made to detach from the bra cups and can vary in size. Generally, the user will slide one of the hooks 52 into one of the loops 54, and then slide the other hook through the other loop, which adjoins the two bra cups together.

Figure 6:
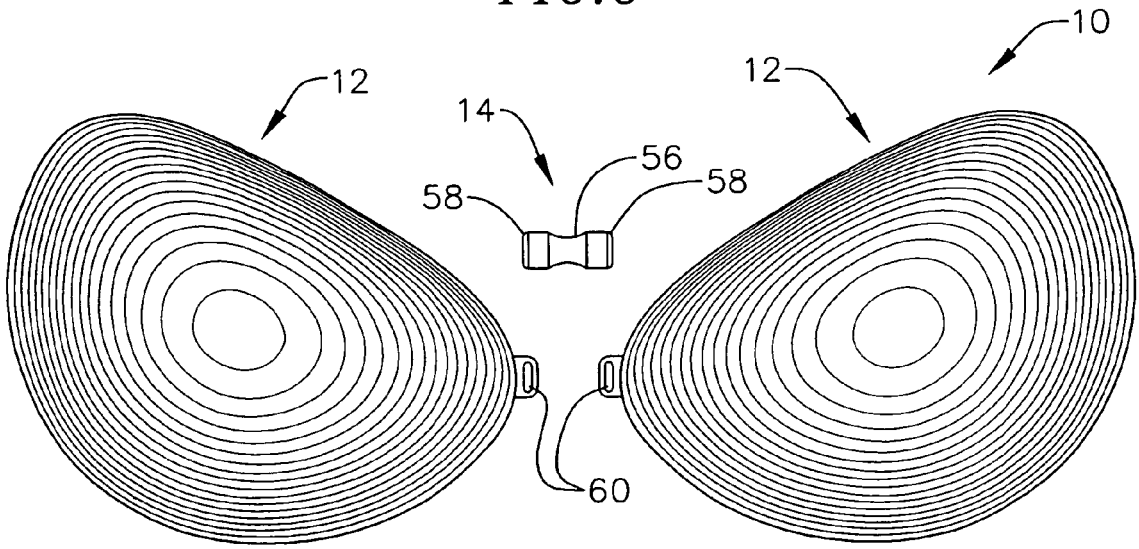
FIG. 6 is a front view of the bra of FIG. 5 having a different single unit connector.

Another embodiment of the connector 14 is shown in FIG. 6. Similar to FIG. 5, the connector 14 is a single unit that engages openings that extend from each bra cup. The connector 14 has a rigid body 56 with a pair of rigid arms 58 extending from each end of the body. The arms 58 are adapted to snap into receptacles 60 that extend from the inner side of each bra cup. Once the arms are snapped into the receptacles, the two bra cups are engaged.

The single unit connectors shown in FIGS. 5 and 6 can each be made into more than one piece, or configured to attach (either permanently or removably) to the one or more of the bra cups. For example, in FIG. 5, rather than having a pair of hooks 52 attached at both ends of the connector body 50, a single hook could be attached at one end of the body 50 and the other end of the body could be fixed to one of the bra cups. In this configuration, one bra cup would have a loop 54 extending from its inner side, and the other bra cup would have the body of the connector with a hook attached thereto. Accordingly, it is understood that there are many possible configurations for the connector 14 and the manner in which it connects to the bra cups. Furthermore, it is understood that the connector can be a single unit that is permanently and inseparably adjoined between the two bra cups, such that the bra cups are inseparable; such a construction could resembly the bra shown in FIG. 1. Additionally, the bra cups 12 can be used without a connector to form the bra 10.

Figure 7:
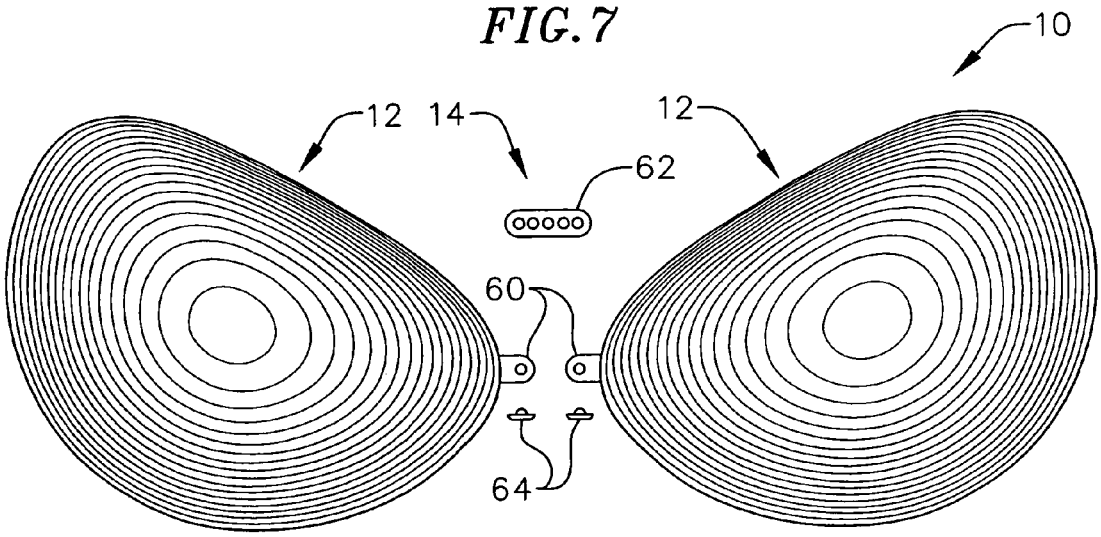
FIG. 7 is a front view of the bra of FIG. 1 having an adjustable connector assembly.

Further embodiments of the bra 10 can be achieved by making minor alterations to the connector 14 and the bra cups. For example, referring to FIG. 4*a*, the first portion 42 and the second portion 44 could be mating portions for a VELCRO hook and loop fastener strap, wherein the first portion includes a strip having a plurality of minute hooks and the second portion includes a corresponding strip with a surface of uncut pile. Also, the receptacles 60 shown in FIG. 6 could be changed in shape to be circular or could be made into metal or plastic rings. Further, the connector 14 could simply be a piece of string, or the like, that passes through the rings and allows the user to tie a knot to adjoin the two bra cups. An additional embodiment is shown in FIG. 7, wherein the connector 14 includes a mounting strap 62 and a pair of plugs 64. The mounting strap 62 has a plurality of holes that are adapted to engagingly receive the plugs 64. The bra cups each have a receptacle 60. The user adjoins the bra cups by aligning one of the holes on the mounting strap with each of the receptacles, and then inserting the plugs through the receptacles and mounting strap. The user can adjust the amount of breast cleavage by adjoining the bra cups closer together on the mounting strap.

Figure 9:
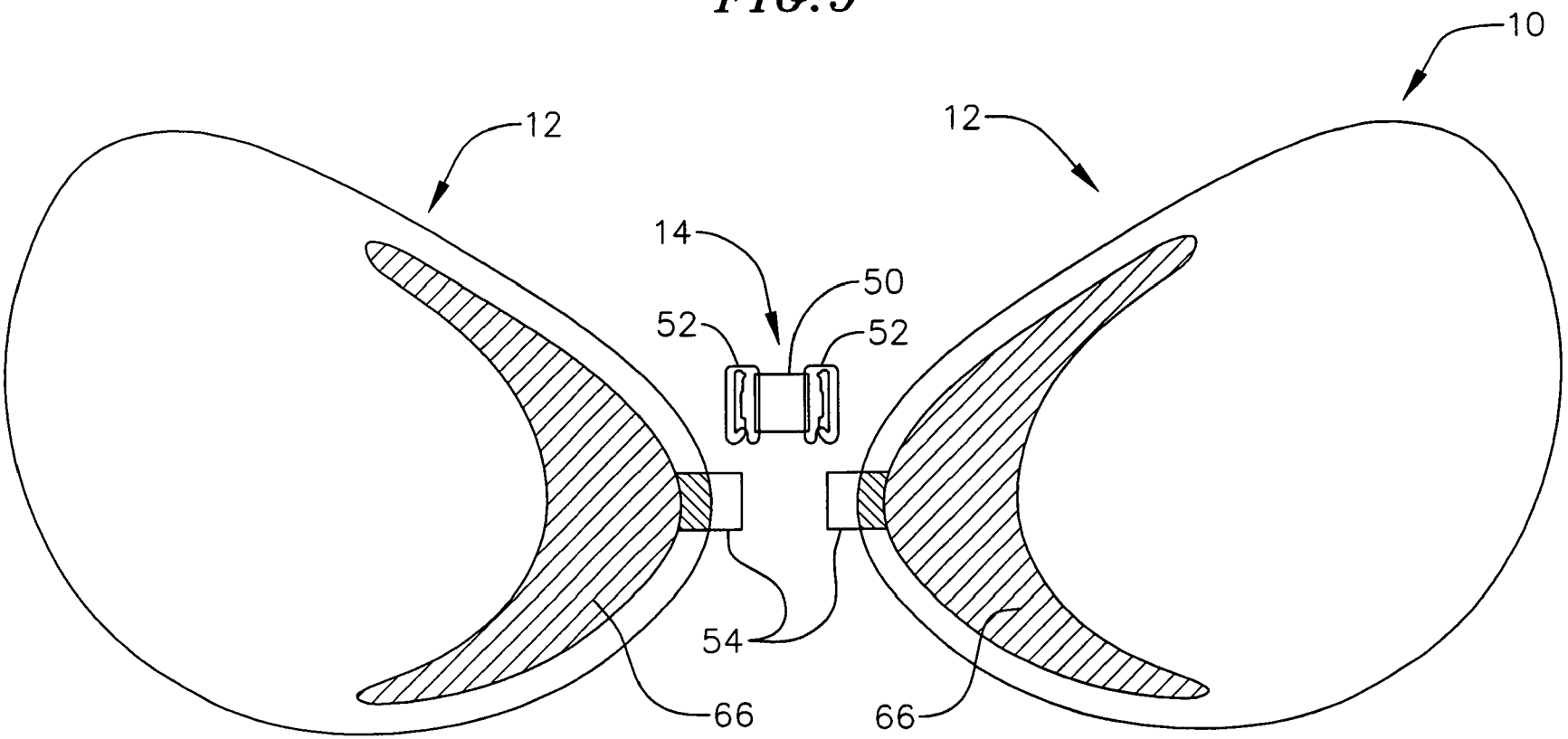
FIG. 9 is a front view of the bra of FIG. 5 wherein the connector includes a subassembly of connector patches.

The manner in which any of the permanently or removably attached portions of the connector are adjoined to the bra cups can vary. The same is true with respect to portions of the bra cup that are adapted to engage the connector. The various portions of the connector and the bra cup could be attached by stitching, heat sealing, adhesives, or any other suitable means. For example, the connector can be part of a sub-assembly that attaches to the bra cups. Referring to FIG. 9, the bra of FIG. 5 is shown further comprising a pair of connector patches 66. The connector patches 66 are each a subassembly that houses the loops 54, which receive the hooks 52 in order to adjoin the bra cups. Accordingly, the loops are integrally joined to the connector patches 66, which separately adjoin to the bra cups. The connector patches can have many different shapes and sizes, and can be made from a number of materials, such as a fabric of film material. For example, if the subassembly is made of a thermoplastic film, then it can be heat sealed to the interior or exterior surface of the bra cup, or the connector patch can have a permanently grown adhesive that allows the subassembly to be removably attached to the bra cup. Therefore, many options exist for adjoining the connector with the bra cups.

Once the user adjoins the bra cups to their skin and creates the desired look and position, the user can create greater breast cleavage by pulling the bra cups together to engage the connector. Furthermore, if the user wants to push-up the breasts, the user can position the bra cups at a lower and more outward position on the breasts, and then adjoin the bra cups with the connector, or can select a bra that positions the connector a lower region of the bra cups.

Figure 8:
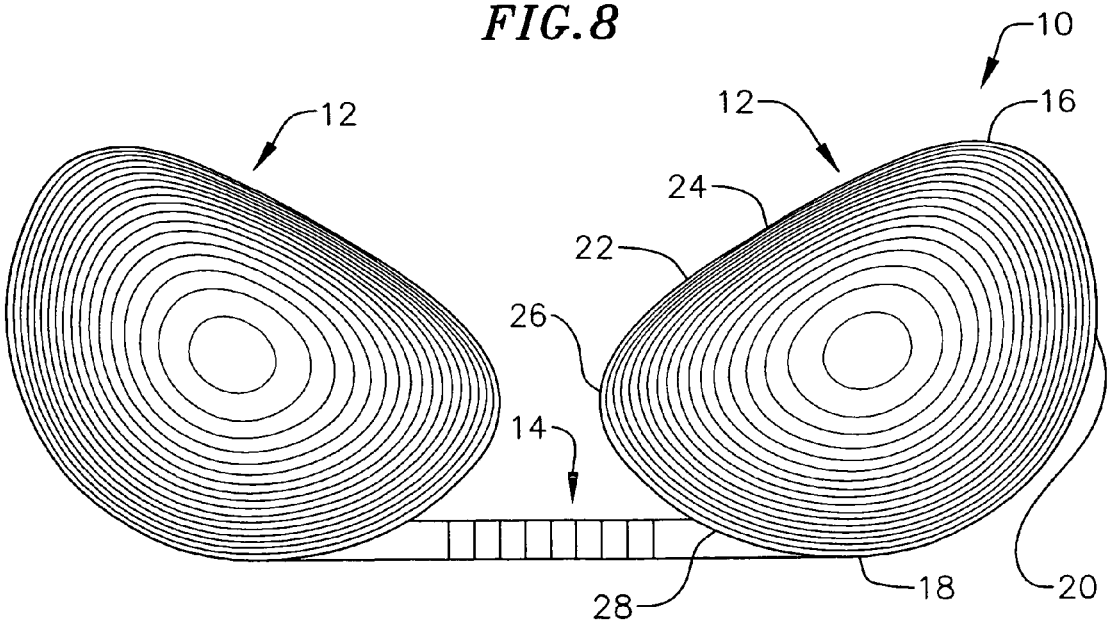
FIG. 8 is a front view of the bra of FIG. 1 wherein the connector is positioned between the bottom inner portions of the bra cups.

The placement of the connector relative to the top 16 and bottom 18 of the bra cups will control the amount of push-up enhancement. For example, compare the positioning of the connector 14 in FIG. 8 to the positioning of the connector 14 in FIG. 1. The connector in FIG. 1 is positioned at the inner middle 26 portion of the bra cups. The connector in FIG. 8 is positioned at the inner bottom 28 portion of the bra cups and, as a result, when the bra cups are adjoined by pulling them together to engage the connector, the user's breasts are pulled together and pushed upward. Therefore, the present bra 10 provides more or less push-up enhancement by regulating the placement of the connector.

Figure 10:
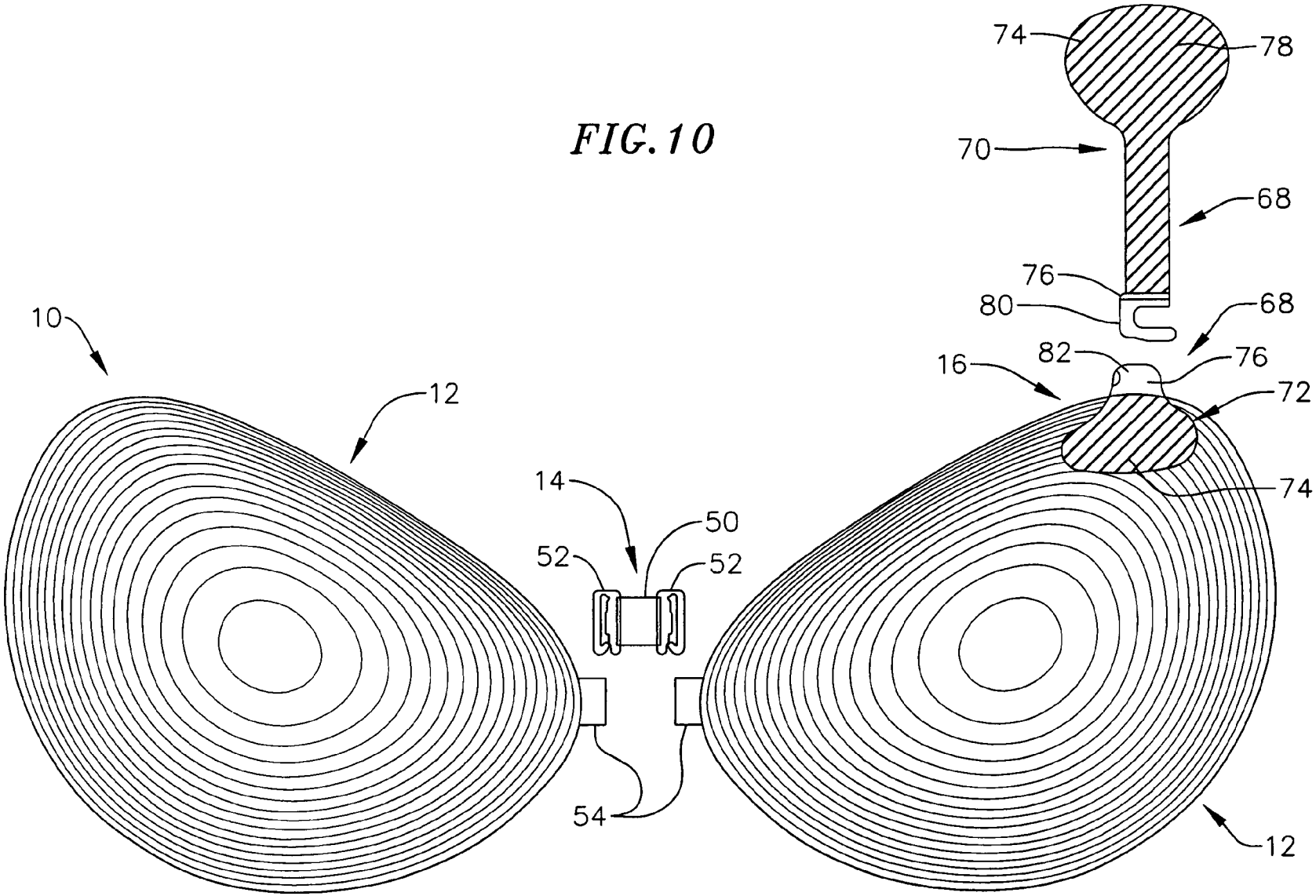
FIG. 10 is a front view of the bra of FIG. 5 having an additional pull-up device attached to the bra cup.

An additional feature of the bra 10 that allows a user to create additional breast push-up enhancement is a pull-up device 68, shown in FIG. 10. The pull-up device 68 is an optional device that attaches to the top surface 16 of the bra cup 12 and to the user's skin in order to provide a means for lifting the bra cup and the user's breasts. One pull-up device is shown in FIG. 10, but it is understood that a second pull-up device would be used for the other bra cup. Each bra cup 12 will have a separate pull-up that separately lifts each bra cup and each of the user's breasts. The pull-up device 68 generally comprises two or more portions that are designed to cooperatively engage. The pull-up device shown in FIG. 10 has two separate portions, namely a strap portion 70 and an anchor portion 72. The strap portion 70 is the portion of the pull-up device that attaches to the user's skin—at a position above the user's breast—and the anchor portion 72 is the portion that attaches to the top of the bra cup.

The strap portion 70 and the anchor portion 72 are designed to cooperatively engage each other. Both the strap portion 70 and the anchor portion 72 have two ends, namely an attachment end 74 and a connection end 76. For the strap portion, the attachment end 74 is the end that attaches to the user's skin, and for the anchor portion, the attachment end 74 is end that attaches to the bra cup. The attachment end of the strap portion has a pressure sensitive adhesive layer 78 on the surface that attaches to the user's skin. The pressure sensitive adhesive layer can have the same properties and features as the pressure sensitive adhesive layer 33 discussed above. The attachment end 74 of the anchor portion can also have the pressure sensitive adhesive layer 78 that allows the anchor portion to be removably attached to the bra cup. Alternatively, the anchor portion can be permanently adjoined to the bra through other suitable means such as stitching, heat lamination, or permanent adhesive. Furthermore, the attachment end 74 of the anchor portion can be attached to either the interior surface 30 of the bra cup, or to the exterior surface 32, or to both surfaces of the bra cup.

Concerning the connection end 76 of the strap portion and the anchor portion, a variety of different configurations can be used to obtain cooperative engagement between the two ends. In the configuration shown in FIG. 10, the connection end of strap portion has a hook member 80, and the connection end of the anchor portion has a loop member 82. The pull-up device is shown with the anchor portion attached to the bra cup, and the connection ends of the anchor portion and the strap portion are not cooperatively engaged. The hook member is designed to engage the loop member to adjoin the strap portion and the anchor portion. Various other connection means can be used to accomplish this engagement, such as the various type of connecting means discussed above with respect to the connector 14 that adjoins the two bra cups.

The user of the bra 10 can achieve significant push-up enhancement by using the pull-up device 68. The user can attach the attachment end 74 of the anchor portion to the top of the bra cup (or the anchor portion could be permanently attached already) and then engage the connection end of the strap portion with the connection end of the anchor portion. Then, the user can pull the strap portion upward towards the user's shoulder, which results in the user's bra cup and breast being pulled upward. When the user's breast is lifted to position that creates the breast push-up enhancement desired by the user, the user can maintain that position by adjoining the attachment end 74 of the strap portion to the user's skin. The pressure sensitive adhesive layer 78 on the strap portion will retain the user's bra cup and breast in this lifted, pushed-up position until the user chooses to remove the strap portion from their skin. Unlike known backless, strapless bras that use extension tabs or the like to retain the bra on the user's skin, the present bra only needs the pressure sensitive adhesive layer to retain the bra cups on the user's skin.

The particular materials and sizes of the strap portion and the anchor portion can vary. For example, both portion can be made of a number of suitable fabrics, polymers, or rubbers. Additionally, the length of the strap portion can be varied depending on a number of factors such as the size of the bra cup and the user's breasts. Similarly, the shape of the pull-up device, including its respective portions, can be varied to any shape desired that provides sufficient surface area for maintaining attachment to the bra cup and the user's skin.

It is also possible for the pull-up device 68 to be a single unit or portion, or likewise have more than two portions. For instance, the strap portion and the anchor portion can be integrally and inseparably joined as a single unit, such that the pull-up device in effect has two ends that are both attachment ends 74, wherein one end attaches to the user's skin and the other end attaches to the bra cup. Therefore, it is clear that the pull-up device 68 can be beneficially employed with the bra 10 in variety of different manners and configurations.

In addition to the specific features and embodiments described above, it is understood that the present invention includes all equivalents to the structures and features described herein, and is not to be limited to the disclosed embodiments. For example, the size and shape of the bra cups can be varied to any configuration desired by a user of a bra, including various types of partial cup constructions that cover different portions of the user's breasts. Additionally, individuals skilled in the art to which the present bra pertains will understand that variations and modifications to the embodiments described can be used beneficially without departing from the scope of the invention.

What is claimed is:

1. An improved backless, strapless bra comprising:

a pair of bra cups, wherein each bra cup comprises:

an interior surface facing towards a user's breast, wherein the interior surface assumes the shape of the user's breast and has a pressure sensitive adhesive layer for securing the bra cup to the user's breast;

a thermoplastic film material layer supporting the pressure sensitive adhesive layer; and a connector adapted to adjoin the bra cups together, wherein the connector is positioned between inner sides of each of the bra cups, wherein the only layer between the thermoplastic film material layer and the user is the pressure sensitive adhesive layer.

2. The bra of claim 1 wherein the connector comprises a first portion attached to the inner side of one of the bra cups and a second portion attached to the inner side of the other bra cup, and the first portion and the second portion are adapted to cooperatively engage.

3. The bra of claim 2 wherein the first portion includes a clasp and the second portion includes a plurality of loops adapted to receive the clasp.

4. The bra of claim 2 wherein the first portion and the second portion are removably attached to the bra cups.

5. The bra of claim 2 wherein the first portion and the second portion are permanently attached to the bra cups.

6. The bra of claim 2 wherein the first portion comprises a strip having a plurality of minute hooks and the second portion comprises a corresponding strip with a surface of uncut pile.

7. The bra of claim 1 wherein the connector is a single unit adapted to removably adjoin to the inner side of each of the bra cups.

8. The bra of claim 1 wherein the connector is a single unit permanently adjoined to the inner side of each of the bra cups.

9. The bra of claim 8 wherein the connector comprises an elastic material.

* * * * *